US005098138A

United States Patent [19]

Vandewege

[11] Patent Number: 5,098,138

[45] Date of Patent: Mar. 24, 1992

[54] BUILDING CLOSURE SECURITY DEVICE

[76] Inventor: Orville Vandewege, 916 W. Laguna Dr., Tempe, Ariz. 85282

[21] Appl. No.: 208,070

[22] Filed: Jun. 17, 1988

[51] Int. Cl.[5] ..... E05C 17/44

[52] U.S. Cl. ..... 292/66; 292/338; 292/DIG. 15

[58] Field of Search ..... 292/338, 339, DIG. 15, 292/DIG. 49, 66

[56] References Cited

U.S. PATENT DOCUMENTS

| | | | |
|---|---|---|---|
| 561,373 | 6/1896 | Campbell | 292/338 |
| 1,185,547 | 5/1916 | Rugar | 292/338 |
| 1,847,705 | 3/1932 | Yorger | 292/338 |
| 2,123,188 | 7/1938 | Hurlbut | 292/338 |
| 3,809,419 | 5/1974 | Chezem | 292/338 |
| 4,456,291 | 6/1984 | Brogie | 292/338 |
| 4,494,784 | 1/1985 | Haynes | 292/338 |
| 4,514,000 | 4/1985 | Chezem | 292/339 |
| 4,607,870 | 8/1986 | Crisp, Jr. et al. | 292/338 |
| 4,666,195 | 5/1987 | Thomas, III | 292/338 |
| 4,673,203 | 6/1987 | Chezem | 292/339 |
| 4,759,577 | 7/1988 | Thomas, III | 292/DIG. 49 X |

FOREIGN PATENT DOCUMENTS

| | | | |
|---|---|---|---|
| 7504 | 4/1908 | United Kingdom | 292/DIG. 15 |
| 8469 | 8/1928 | United Kingdom | 292/66 |

*Primary Examiner*—Eric K. Nicholson

*Attorney, Agent, or Firm*—James F. Duffy; Robt. Von Hellens

[57] ABSTRACT

A door and window supplemental security device prevents unauthorized entry through a closed or partly open door or window by bracing the door or window against a floor or window casement. The device is rapidly and easily released in the event of a fire or other emergency. It may be folded in half for transport to hotels. The device includes an axially translatable rod actuated by a manually operated over center mechanism disposed at one end of the rod to lock the rod in an axially extended position. Brace means is disposed at the other end of the rod for frictionally engaging a fixed surface upon axially extension of the rod. The brace means includes a pivotally attached component which pivots upon extension to effect the frictional contact.

13 Claims, 3 Drawing Sheets

BUILDING CLOSURE SECURITY DEVICE

BACKGROUND OF THE INVENTION

1. Field of the Invention

This invention relates to security devices and, more particularly, to a quick-release security device for use on the inside of a hinged or sliding building closure to hamper unauthorized and/or undesirable opening of the closure.

2. Description of Prior Art

The prior art is replete with supplementary building closure security devices and particularly door security device which are intended for use in conjunction with conventional door latching mechanisms that, in the instances of outside doors, always include a key-operated lock. Most people are well aware of the short comings of the conventional door latching mechanisms in so far as security is concerned. The key-operated locks of such conventional door latches are relatively easy to pick, and along with the door and door jamb structures, do not constitute a very strong assembly. An experienced burglar is often able to defeat the security of these conventional door latches by simply kicking the door proximate the outside door knob.

For this reason, most outside doors today are equipped with some sort of supplemental security device such as a dead-bolt lock, a door chain device, or the like. However, skilled burglars can, and often do gain entry, even when the doors are equipped with such supplemental security devices.

Briefly, there are two types of dead bolt locks, namely those which are operated manually on the interior side of the door and those which must be operated with a key on both sides or a door. The latter of these types of dead bolts is recommended for maximum security and when a door is provided with the recommended type of dead bolt, there is no visual indication that the lock has been set. This, in addition to forgetfulness, often results in dead bolt locks being left unset.

Further, the installation work required to retrofit an existing door with a dead bolt lock is beyond the skills of many people. Many residential occupants are unable, or unwilling to pay someone else to make the installation.

Another type of door security device in relatively common usage is a chain device in which one end of the chain is fixed to a bracket carried on the door and is selectively connectable to another bracket that is mounted on the door jamb. This type of security device allows a door to be opened a few inches before the chain is moved into a taut position wherein it is intended to prevent further opening of the door. However, once the door is opened those few inches, which is relatively easy for an experienced burglar to accomplish, the chain can be easily cut. Also, once opened those few inches, the door can be opened the rest of the way by a burglar forcefully pushing on the door so that one or the other, or both, of the mounting brackets will be pulled loose from their mounted positions.

Even though door security is improved with the use of the supplemental security devices discussed above, the weakness for the most part is in the door per se and in the door jamb rather than the security device.

For this reason, several attempts have been made to devise an aesthetically acceptable and otherwise appealing door security device which braces the door against unauthorized or unwanted opening by bearing against the floor rather than being coupled in one manner or another to the structurally inferior door jamb.

Examples of prior art door security devices of the type which may be generally referred to as brace-type security devices are represented in U.S. Pat. No. 790,653, issued to H. Notthoff; U.S. Pat. No. 1,304,394, issued to J. D. Shyer; U.S. Pat. No. 4,438,640, issued to R. E. Willis; and U.S. Pat. No. 4,563,027, which issued to D. W. Checovsky et al. Each of these security devices includes one or more rods, wedged underneath a door knob so as to extend angularly and downwardly from the knob into bearing engagement with the floor. This brace-type door security device has not achieved much, if any, in the way of commercial success. This may be due at least in part to the lack of aesthetic appeal, the need for the brace rod(s) to extend angularly into the room quite far, the need for storage after each use, and the need for retrieval and reinstallation each time it is to be used. Therefore, a need exists for a new and improved supplementary building closure security device which overcomes some of the problems and shortcomings of the prior art.

SUMMARY OF THE INVENTION

In accordance with the present invention, a new and improved building closure security device is disclosed which is primarily intended for use on the inside of an inwardly opening door to prevent, or at least hamper, unauthorized and/or undesirable opening of the door. The security device includes a brace means that is disposed proximate the lower edge of the door. The brace means is operable between a retracted position wherein it is out of engagement with the floor adjacent the door and an extended position wherein it is in wedged bearing engagement with the floor to brace the door against opening. An elongated actuating rod extends upwardly from the brace means and has its upper end coupled to an operating means which is disposed immediately below the door knob for the sake of convenience.

In the preferred embodiment, the operating means and the brace means are both secured to the door in what may be referred to as a permanently mounted position. In another embodiment, the operating means and the brace means are carried on an elongated plate which is demountably attachable to the door. This latter embodiment is suitable for use when traveling so that the security device of the present invention mag be put to temporary use in hotels or motels.

The operating means includes a manually operable handle which is coupled by an over-center linkage to the upper end of the actuating rod. Raising of the handle will pull the rod up and thereby move the brace means to its retracted position. Lowering of the handle does just the opposite, it pushes the rod down which, in turn, moves the brace means to its extended position. When the handle is lowered for this purpose, the linkage will move to its over-center position and the only way that it can be unlocked is by manual lifting of the handle.

The brace means includes a bearing plate with a pressure foot on its lower end, and the bearing plate is pivotably coupled to the lower end of the actuating rod. The bearing plate is movable in response to manual operation of the operating means to provide the retracted and extended positions of the brace means. When in the extended position, the bearing plate extends angularly and downwardly from a point just above the lower edge of the door so that the pressure foot engages the floor in close proximity to the door, and thus does not extend an objectionable distance into the room. The angular attitude of the bearing plate in conjunction with the actuating rod and over-center linkage provides the desired wedge-like bracing of the door in the closed position.

While the security device of the instant invention is intended primarily for use as a supplementary door security device, it may also be used, with minor modifications, for securing sliding windows, sliding glass doors, and the like.

Accordingly, it is an object of the present invention to provide a new and improved supplementary building closure security device.

Another object of the present invention is to provide a new and improved supplementary closure security device which utilizes a wedging action to brace an inwardly opening door or a sliding building closure in the closed position and thereby prevent unauthorized and/or unwanted opening of the door or sliding closure.

Another object of the present invention is to provide a security device of the above described character wherein the device includes a manual operating means that is located proximate the door knob of the door and includes an over-center linkage which is coupled by an actuating rod to a brace means that is movable from a retracted position to a locked extending position of being in braced bearing engagement with the floor adjacent the inside of the door.

The foregoing and other objects of the present invention as well as the invention itself, may be more fully understood when read in conjunction with the accompanying drawings.

DESCRIPTION OF THE PREFERRED EMBODIMENTS

Figure 1:
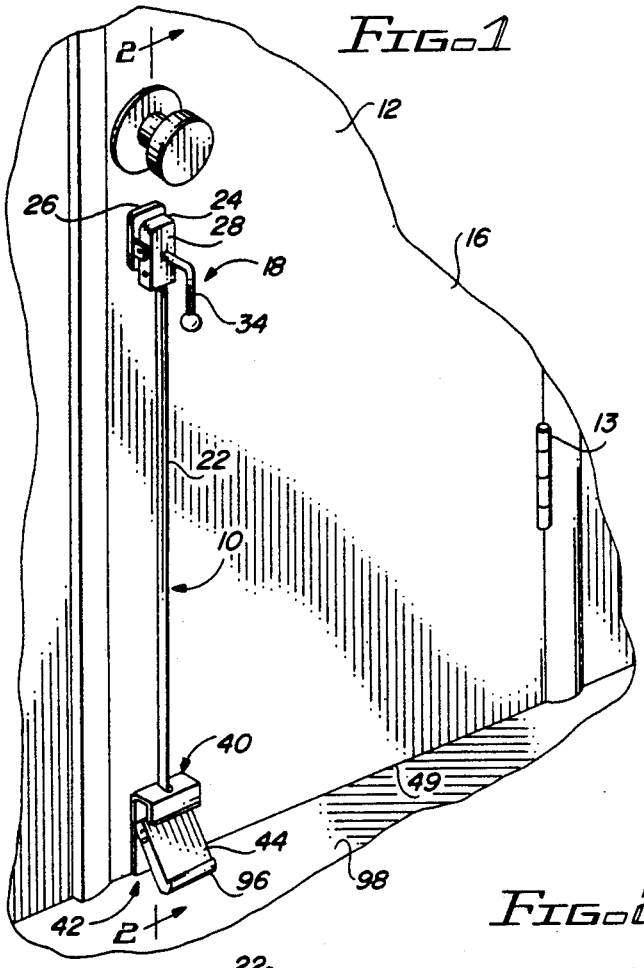
FIG. 1 is a fragmentary perspective view of the inner surface of an inwardly opening door with the first embodiment of the door security device of the present invention mounted thereon.

Referring more particularly to the drawings, FIG. 1 shows the first embodiment of the door security device of the present invention, which is indicated generally by the reference numeral 10, and which is shown as being mounted on a typical door 12.

As will become apparent as this description progresses, door security device 10 is intended to prevent unauthorized and/or undesired opening of an inwardly opening door by a person or persons on the outside of the door. Therefore, door 12 shown in FIG. 1 is intended to represent an inwardly opening door having the usual hinges 13(one shown), door knob 14; the door security device 10 is mounted on inwardly facing surface 16 of the door.

Figure 2:
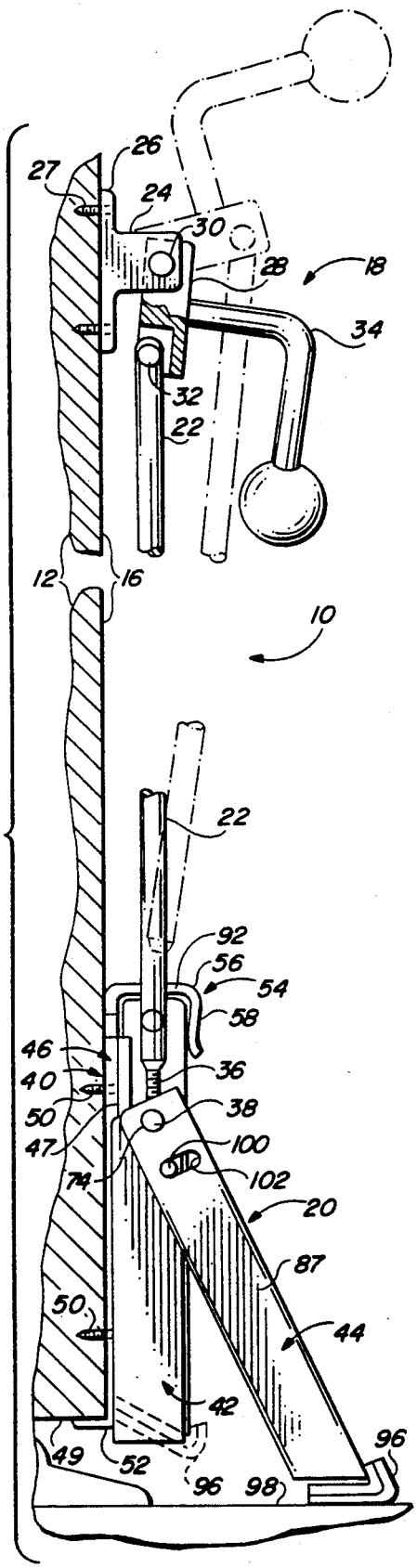
FIG. 2 is an enlarged fragmentary sectional view taken along the line 2—2 of FIG. 1.
Figure 3:
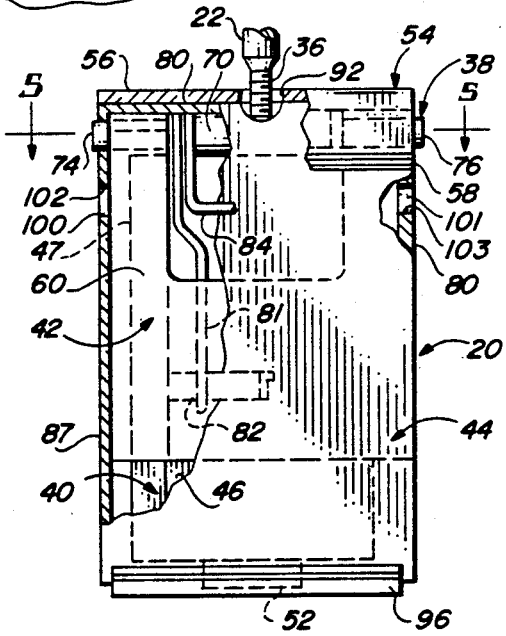
FIG. 3 is a front view of the brace means portion of the door security device of FIGS. 1 and 2 with portions being broken away to show the various features thereof.

Door security device 10 includes the major assembly, or components of a manual operating means 18, a brace means 20, and an interconnecting actuating rod 22, as will now be described in detail. Operating means 18 includes a clevis 24 having a plate portion 26 which is attached to door 12 such as by illustrated screws 27. A pivot arm 28 has one of its ends pivotably connected between the tines of clevis 24 by a suitable pivot pin 30, and the other end of pivot arm 28 is pivotably attached to the upper end of actuating rod 22 by another pivot pin 32. A [handle means 34 is connected, such as by welding, to extend from pivot arm 28 in a manner whereby pivot arm 28 may be manually moved between the solid and dashed lines positions shown in FIG. 2. As will become apparent as this description progresses, the solid line position of operating means 18 constitutes the operative position thereof and the dashed line position constitutes the inoperative position.

Elongated actuating rod 22 includes threads 36 on its lower end and is threadingly attached to a pivot bar assembly 38 of brace means 20 as will hereinafter be described. As seen best in FIG. 2, the relative positions of the axes of pivot pins 30 and 32 and pivot bar assembly 38, when operating means is in the operative position, forms an over-center condition. Thus, when the operating means 18 is in the solid line operative position, the only way that it can be unlocked and moved up is by manual moving of handle means 34 to pull the pivot pin 32 back from its over-center position to an under-center location. When in the over-center position, any upward force on actuating rod 22 will cause pivot arm 28 to move in the wrong direction, i.e. towards door 12, and the door acts as a stop which prevents upward movement of actuating rod 22. As seen best in FIGS. 2, 3, 4 and 5, brace means 20 has three main components, a back plate 40, a carriage 42 and a bearing plate 44.

Back plate 40 includes a plural body 46 which is bent or otherwise formed to provide an opposed pair of side edges 47 and 48 that are offset and act as guide rails for mounting and movement of carriage 42 relative to back plate 40. Back plate 40 is mounted to door 12 adjacent its bottom edge 49, such as by mounting screws 50, with guide rail edges 47 and 48 being vertically oriented. Back plate 40 may be further bent at its bottom edge to provide a hook member 52 which bears against bottom edge 49 of door 12 when mounted thereon. Further, back plate 40 is configured at its upper end to provide a downwardly opening transverse channel member 54 having a top wall 56 which serves as a stop in that it limits the upward movement of carriage 42. Further, the channel member 54 includes a front lip, or flange 58, which deflects bearing plate 44 from an angularly extending position when brace means 20 is inoperative, as will hereinafter be described in detail.

Figure 5:
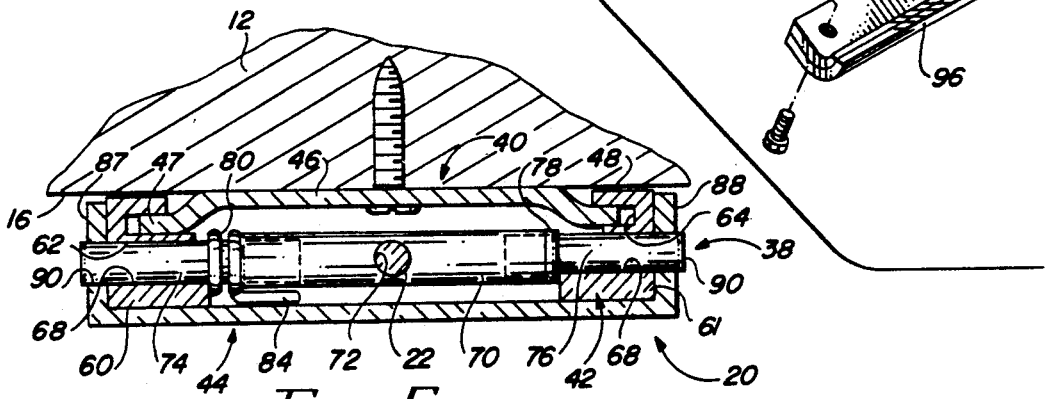
FIG. 5 is an enlarged fragmentary sectional view taken along the line 5—5 of FIG. 3.

Carriage 42 includes a pair of side bars 60 and 61 which are formed with elongated inwardly opening grooves 62 and 64 therein which, as seen best in FIG. 5, are in slidable mating engagement, with guide rail side edges 47 and 48, respectively, of back plate 40. The lower ends of the side bars 60 and 61 are interconnected by means of an integral plate 66, and the spaced apart upper ends of the side bars are each provided with an aperture 68. The previously mentioned pivot bar assembly 38 is mounted so as to extend between apertures 68 provided in side bars 60 and 61, and bearing plate 44 is pivotably coupled to carriage 42 by means of pivot bar assembly 38.

Pivot bar assembly 38 includes a cylindrical central rod 70 having an internally threaded transverse bore 72 in which threaded lower end 36 of actuating rod 22 is mounted. A pair of reduced diameter pivot pins 74 and 76 are mounted so as to extend axially and oppositely from cylindrical rod 70 and pass through apertures 68 of side bars 60 and 61 of carriage 42. A spacer washer 78 is interposed between one end of central rod 70 and side bar 61 of carriage 48, and a torsion spring 80 is coiled around pivot pin 74 so as to be disposed between the other end of cylindrical central rod 70 and side bar 60 of carriage 42. One end 81 of the coiled torsion spring 80 is looped around a fixed pin 82 carried on carriage 42, and end 84 of spring 80 bears against bearing plate 44 to bias it into the angular position shown in FIG. 2.

Bearing plate 44 is of substantially planar configuration having a front surface 86 with side flanges 87 and 88 extending normally from the opposite longitudinal side edges of front surface 86. Side flanges 87 and 88 are provided with apertures 90 at their upper ends through which the extending ends of pivot pins 74 and 76 extend so that bearing plate 44 is pivotably movable about the pivot axis defined by pivot bar assembly 38

Actuator rod 22 is attached, as hereinbefore described, to pivot bar assembly 38 and to accommodate such attachment, top wall 56 of channel member 54 of back plate 40 is provided with an oblong clearance hole 92 and the upper end of the bearing plate 44 is notched at 94. In this manner, vertical movements imparted to actuating rod 22 by operation of operating means 18 will cause carriage 42 and bearing plate 44 carried thereon to move up and down on back plate 40 when carriage 42 is moved down to the solid line position shown in FIG. 2, bearing plate 44 will be pivotably moved to the illustrated angular position by virtue of torsion spring 80. When in this position, a pressure foot 96, which is mounted on the lower end of bearing plate 44 such as by the illustrated nut and bolt arrangement, will be in bearing engagement with floor 98 proximate bottom end 49 of door 12. When operating means 18 is manually operated to move device 10 into its inoperative position, carriage 42 will be moved upwardly on back plate 40, and of course, bearing plate 44 will move upwardly with the carriage. During this upwardly movement, front planar surface 86 of bearing plate 44 will move into engagement with front lip 58 of channel member 54. After making contact with front lip 58, continued upward movement of bearing plate 44 will deflect it inwardly into the folded dashed line position shown in FIG. 2.

Figure 4:
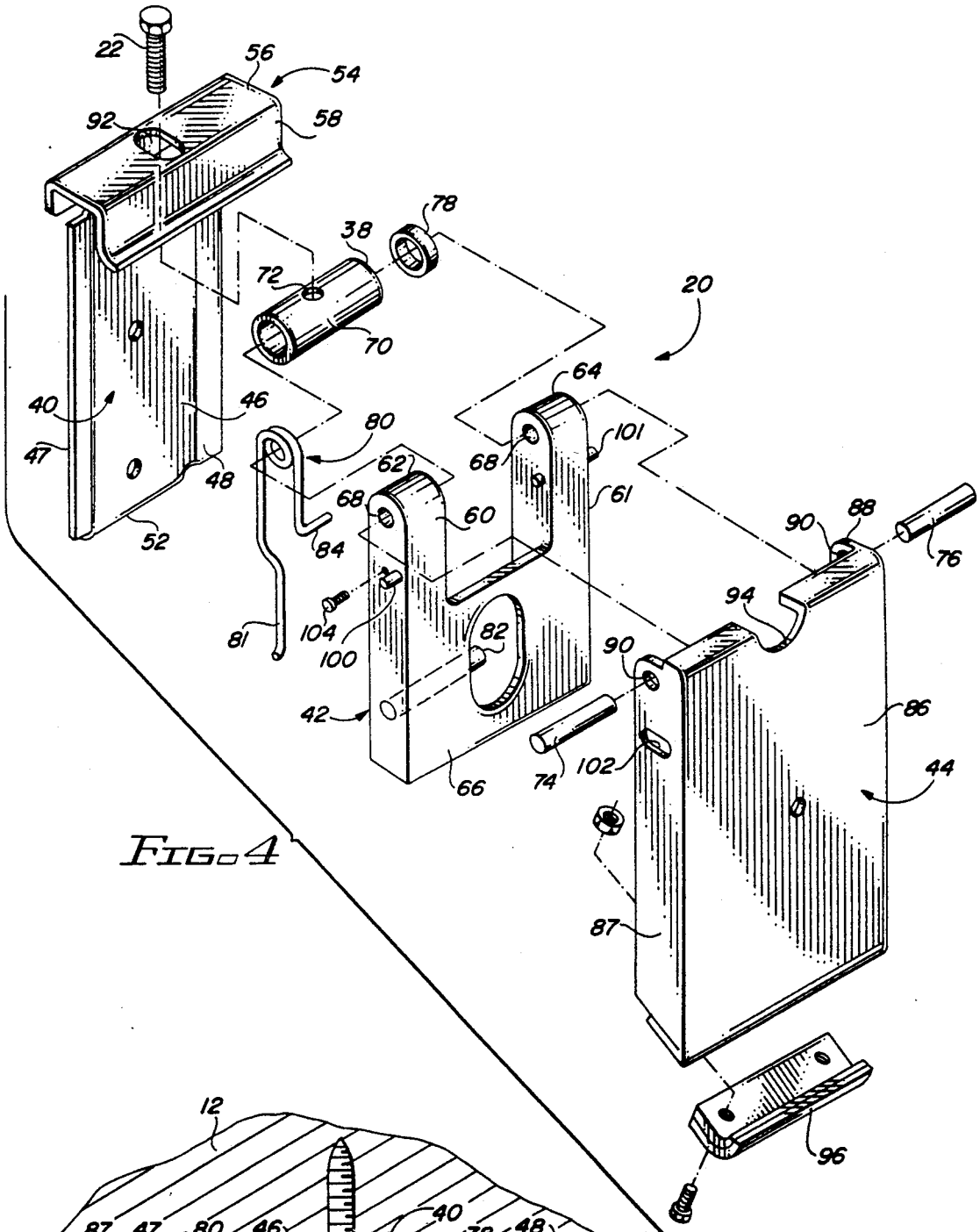
FIG. 4 is an exploded perspective view of the brace means to FIGS. 1, 2 and 3.

Carriage 42 has a pair of pins 100 and 101 which are each fixedly carried on a different one of side bars 60 and 61, and are disposed so as to extend from the opposite sides of the carriage. Bearing plate 44 is provided with an aligned pair of oblong openings 102 and 103 in their side flanges 87 and 88, respectively, and pins 100 and 101 of carriage 42 extend through openings 102 and 103, respectively. This pin and opening arrangement allows bearing plate 44 to move freely from its folded to its extended position and is used as a stop which prevents torsion spring 80 from moving the bearing plate beyond its desired angularly extending position. It has been found that when security device 10 is to be installed at a site having hard floors, such as wood, concrete, or the like, an extending angular position of bearing plate 44 relative to carriage 42 of approximately 20°. Provides an ideal wedging position of the bearing plate. When the installation site is provided with a carpeted floor, extended angular position of bearing plate 44 relative to carriage 42 should be approximately 25° to allow for compressability of the carpeting. Therefore, it is preferred that a means be provided for quickly and easily adjusting the angular extended position of bearing plate 44 at the time of installation. As seen in FIG. 4, a small screw 104 can be installed adjacent one, or both of pins 100 and 101 for reducing the angle from approximately 25° to 20°. It will be appreciated that other adjustment means (not shown) could be utilized, such as some sort of fastener arrangement which extends from the inwardly facing surface of front surface 86 of bearing plate 44 and adjustably engages plate 66 of carriage 42.

Figure 6:
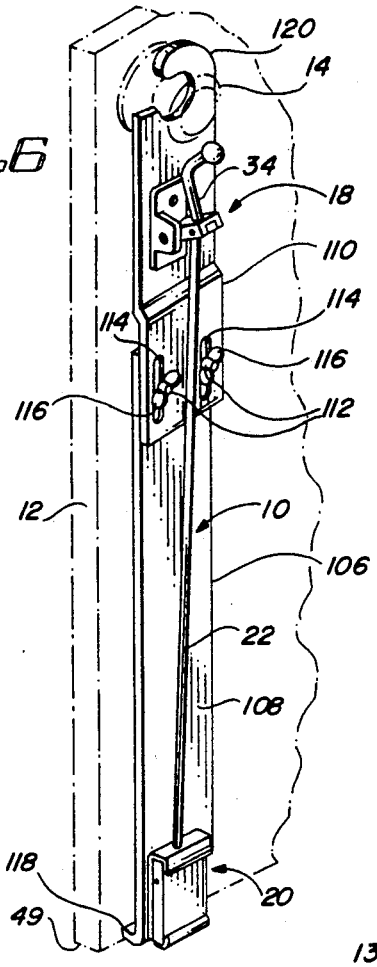
FIG. 6 is a fragmentary perspective view similar to FIG. 2 and showing a means for demountably attaching the door security device of the present invention to the door.

Reference is now made to FIG. 6 wherein door security device 10 is shown as being attached to a mounting plate assembly 106 rather than being attached directly to door 12 in the manner hereinbefore described. When attached to mounting plate 106, door security device 10 is portable and may be used in, for example, motels, hotels, and the like, by travelers. Mounting plate assembly 106 preferably includes a lower plate 108 and an upper plate 110 which are attached to each other in a manner which allows them to be separated for portability reasons. Lower plate 108 has a pair of studs 112 extending normally therefrom from a position proximate the upper end thereof. Studs 112 pass through elongated openings 114 formed in upper plate 110 proximate the bottom edge thereof, and wing nuts 116 are threadingly carried on the studs. In addition to demountably attaching lower and upper plates 108 and 110 to each other, elongated openings 114 allow the longitudinal extent of mounting plate assembly 106 to be adjusted as needed to suit the particular door upon which it is to be mounted. To facilitate attachment to a door, lower plate 108 is provided with a ledge 118 on its lower end for engaging bottom edge 49 of door 12, and the top end of upper plate 110 is provided with a hook means 120 for engaging door knob assembly 14 in the manner shown.

Figure 7:
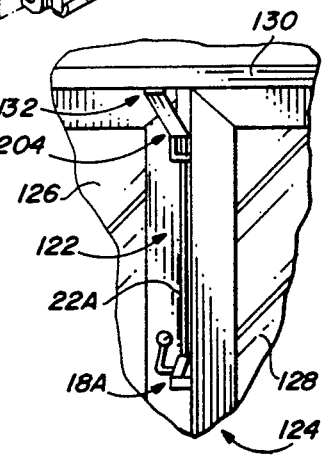
FIG. 7 is a fragmentary elevational view of a sliding building closure such as a window or sliding glass door, with the security device of the present invention mounted thereon.
Figure 8:
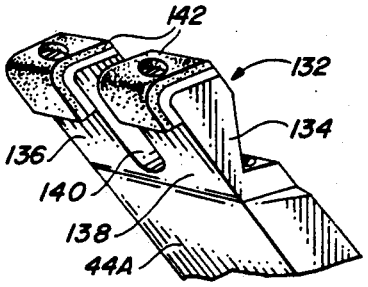
FIG. 8 is a fragmentary perspective view of a modified pressure foot for use on the end of the brace means of the building closure security device of FIG. 7.

Reference is now made to FIGS. 7 and 8 wherein the hereinbefore described first embodiment of closure security device 10 of the present invention is illustrated in a slightly modified configuration and is indicated in its entirety by the reference numeral 122. Security device 122 has been reduced in size in comparison to device 10 so that it can be used on sliding building closures such as the one indicated by numeral 124 in FIG. 7. Sliding closure 124 is intended to be representative of a typical sliding window or sliding door, both of which normally include a fixed glass panel 126 and a sliding glass panel 128 that is slidably mounted between an upper track 130 and a lower track (not shown), as is well known in the art.

Closure security device 122 is preferably mounted in an inverted position on side frame member 131 of sliding glass panel 128 and is operative for selectively engaging upper track 130 in a wedging manner. Security device 122 includes the same major assemblies and components as the previously described device 10, and is therefore provided with a manual operating means 18A, a brace means 20A and an interconnecting actuator rod 22A. Operating means 18A is identical, except for the size as the previously described operating means 18, and rod 22A functions in the same manner as rod 22. Brace means 20A is, however, provided with a special pressure foot 132 which is compatible with upper track 130 in which glass panel 128 is slidably mounted. Pressure foot 132 is mounted on bearing plate 44A in the same manner as foot 96 is mounted on plate 44 of security device 10. Pressure foot 132 includes a bifurcated body 134 which is configured to have a pair of tines 136 and 138 which are separated from each other by a slot 140. Pressure foot 132 is configured in this manner so that the longitudinally extending center rib (not shown) of top track 130 will be disposed in slot 140 of pressure foot 132 when security device 122 is in its operative position, as illustrated in FIG. 7. When bearing plate 44A is in angularly extending operative position, pressure foot 132 will extend into upper track 130 with tines 126 and 128 thereof straddling the center rib (not shown) of track 130 with friction pads 142 that are provided on tines being in wedged bearing engagement with track 130.

Figure 9:
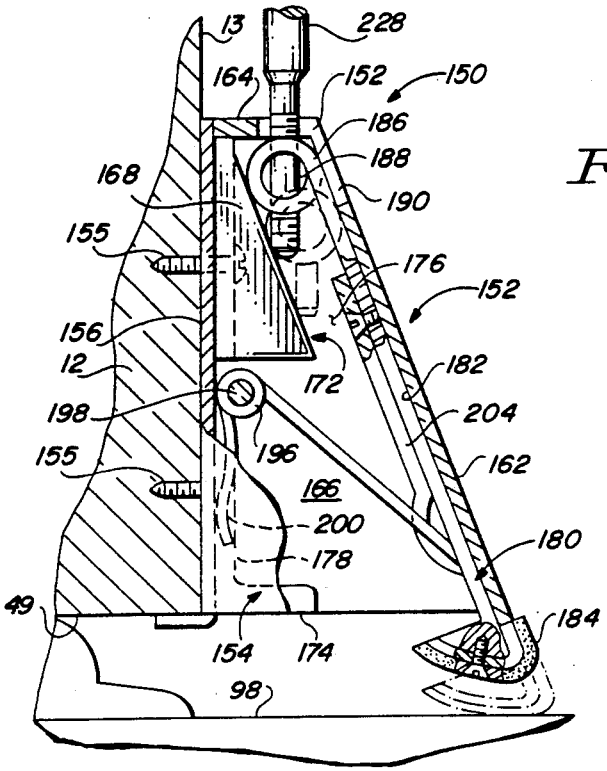
FIG. 9 is a side elevational view that is partially broken away to show the various features of a brace means that forms the second embodiment of the closure security device of the present invention.
Figure 10:
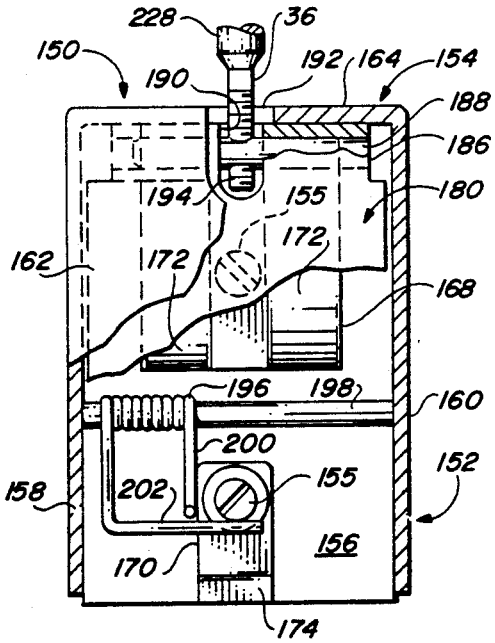
FIG. 10 is a front elevational view which is partially broken away to show the various features of the brace means of the second embodiment shown in FIG. 9.

Reference is now made to FIGS. 9 and 10 wherein a fragmentary portion of a second embodiment of the closure security device of the present invention is shown; this embodiment of the device being indicated in its entirety by reference numeral 150. Although not shown in FIGS. 9 and 10, it is to be understood that closure security device 150 includes a manual operating means of the type shown by numeral 18 in FIG. 2 which in device 150 of this second embodiment is coupled by an actuator rod 22B to a brace means 152.

Brace means 152 includes a housing 154 which is attached to the bottom edge 49 of the door 12 such as by screws 155. Housing 154 has a back wall 156, and opposed pair of spaced apart side walls 158 and 160, a front wall 162 and a top wall 164, all of which cooperatively define a downwardly opening cavity 166 in the housing. Back wall 156 of housing 154 is disposed in a vertical attitude when device 150 is mounted on door 12, and mounting screws 155 pass through suitable apertures formed in back wall 156 for holding housing 154 in the mounted position. In addition to mounting housing 154 on door 12, mounting screws 155 may also be used to mount a ramp block 168 and a stop lug 170 on back wall 156 of housing. For reasons which will hereinafter be described, ramp block 168 is formed with a cam surface 172 that slopes downwardly and angularly away from door 12, and stop lug 170 has a flange 174 that extends normally from back wall 156 of housing 154 toward front wall 162 thereof.

Front wall 162 of housing 154 is disposed to lie at an angle which is the same as that of cam surface 172 of ramp block 168, and is spaced therefrom to provide a channel 176 therebetween.

Brace means 150 further includes a bearing plate 180 which is mounted in channel 176 provided between cam surface 172 of ramp block 168 and inwardly facing surface 182 of front wall 162 of housing 154. Bearing plate 180 is movable in channel 176 between a retracted position shown in solid lines in FIG. 6 and an extended position shown in dashed lines in the same figure. When retracted, bearing plate 180 is out of engagement with floor 98 proximate bottom edge of door 12 so that the security device 150 is in its inoperative state and thus will not interfere in any way with normal openings and closing of door 12. When bearing plate 180 is moved to its extended position in a manner hereinafter to be described, a pressure foot 184 that is mounted on the lower end of bearing plate 180 will be in wedged bearing engagement with floor 98 and will therefore hamper opening of door 12.

The upper end of bearing plate 180 is rolled over as shown to form a cylindrical sleeve 186 in which a pin 188 is mounted for pivotable movement about the longitudinal axis of the cylindrical sleeve. Sleeve 186 is formed with central notch 190 so that threaded lower end 36 of actuator rod 22B, which extends through an opening 192 formed in housing 154, passes through sleeve 186 into threaded engagement with an internally threaded bore 194 that is formed transversely and centrally through pin 188.

From the above it will be seen that movements of operating means 18 (FIG. 2) between its operative and inoperative positions as described above, will move bearing plate 180 between its retracted and extended positions.

Brace means 150 further includes a biasing means in the preferred form of a torsion spring 196 which is wound around a bar 198 that is mounted in housing 154 so as to extend between side walls 158 and 160 thereof. One end 200 of spring 196 bears against back wall 156 of housing 154, and end 202 bears against bearing plate 180 so as to yieldably urge it into contiguous engagement with inwardly facing surface 182 of front wall 162 of housing 154. When bearing plate 180 is in its retracted position, end 202 of spring 196 catches under a latch plate 204 that is mounted on bearing plate 180. When caught in this manner, spring will hold bearing plate 180 in retracted position and operating means 18 (FIG. 2) in inoperative position. When operating means 28 (FIG. 2) is manually moved to its operative position, latch plate 104 will move under end 20 of spring 196 and thereby free bearing plate 180 for movement into its extended position.

When door 12 is closed and brace means 152 of device 150 is in the extended position for securing the door, bearing plate 180 will be in contiguous engagement with front wall 162 of housing 154 in the absence of a door opening force being applied to the door, bearing plate 180 will swing about the longitudinal axis or pin 188 in a clockwise direction as viewed in FIG. 9. Such movement will tend to increase the force applied to pressure foot 184 by more firmly wedging bearing plate 180 against floor 98. However, bearing plate 180 must not be allowed to swing into a vertical position, or beyond such a vertical position, so as not to lose the wedging action of bearing plate 186, such excessive swinging movement is prevented by stop lug 170.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

I claim:

1. A security device for releasably locking a closure to prevent opening movement of such closure, said security device comprising in combination closure opening brace means for locking to prevent closure opening by frictional contact with a nearby fixed surface, said brace means being attached to an elongated rod at a first end of said rod, and actuating means for actuating said brace means connected to a second end of said rod, said actuating means being adapted to actuate said brace means by approximately movement of said rod generally along its elongated axis, said actuating means and said brace means being both attached to the closure, said rod being adapted by virtue of length and rigidity of construction to distribute a force, externally applied to the closure in an effort to open the closure, to said brace means to effect a mechanical advantage to said brace means in resisting closure opening, said brace means comprising a first component composed of rectangular sheet metal formed into a partial enclosure having right angled edges and containing therein and rotatably attached thereto a second component, a spring for impelling said second component outwardly from said closure, said second component being attached to said rod and traversable downwardly therewith and partially out of said first component to release said second component for spring impelled rotation and means for capturing said second component within an angle of rotation of between twenty to twenty-five degrees (20° to 25° ) as measured from said closure.

2. The security device of claim 1 wherein said brace means includes a plate for securing said brace means with said closure and said plate extends between said brace means and said actuating means, said actuating means and said brace means being fixed to said plate, said plate including a flat surface for bearing against said closure for approximately the entire longest dimension of said plate to thereby present a relatively large contact surface area to said closure, said plate being attached to said closure.

3. The security device of claim 2 wherein said plate is attached to said closure at a first end of said plate which first end forms a hanger to hang over and form a handle for opening said closure.

4. The security device of claim 2 wherein said plate is "adjustable in length and is further" attached to a handle for opening said closure.

5. The security device of claim 2 wherein said plate includes length adjustment means for altering the length of said plate to fit a closure.

6. The security device of claim 2 wherein said rod includes rod length adjustment means for altering the elongated length disposed between said brace means and said actuating means.

7. The security device of claim 5 wherein said plate adjustment means comprises slots and bolts.

8. The security device of claim 6 wherein said rod length adjustment means comprises a threaded section of said rod and a threaded coupling attached to said threaded section.

9. The security device of claim 1 wherein said brace means comprises a third component for frictionally contacting a nearby fixed surface, said third component including a channel for avoiding contact with any ridge existing in and extending from the nearby fixed surface.

10. The security device of claim 1, wherein said brace means comprises a third component for frictionally contacting a nearby fixed surface, said third component including a channel adapted to mate with a ridge existing in the nearby fixed surface.

11. The security device of claim 1 wherein said actuation means comprises means for locking said rod in a position corresponding to a locked closure.

12. The security device of claim 1 wherein said brace means comprises means for locking said rod in a position corresponding to an unlocked closure.

13. The security device of claim 1 wherein said closure comprises a sliding window.

* * * * *